US005862943A

United States Patent [19]

Larit

[11] Patent Number: 5,862,943

[45] Date of Patent: Jan. 26, 1999

[54] GRAVITY FED DISPLAY AND DISPENSER

[75] Inventor: Steven Larit, Commack, N.Y.

[73] Assignee: Compare Generiks, Inc., Hauppauge, N.Y.

[21] Appl. No.: 725,894

[22] Filed: Oct. 2, 1996

[51] Int. Cl.[6] ..... B65G 59/00

[52] U.S. Cl. ..... 221/131; 312/45

[58] Field of Search ..... 221/92, 131, 130, 221/123; 312/42, 45, 49

[56] References Cited

U.S. PATENT DOCUMENTS 1,714,469 5/1929 Hoffman ..... 312/45
1,731,544 10/1929 Rockhoff ..... 312/42
5,000,344 3/1991 Janssen ..... 312/45

*Primary Examiner*—Kenneth Noland
*Attorney, Agent, or Firm*—Foley & Lardner

[57] ABSTRACT

The instant invention includes a gravity fed display and dispenser having a rear wall and a base ledge extending from the rear wall adjacent the bottom of the dispenser. A plurality of partitions extend at least substantially between the rear wall and a front cover, forming side-by-side channels, each channel receiving a plurality of containers which are fed by gravity and displayed in successive order. The rear wall, base ledge and partitions are formed in a single molded unit, with the cover resting in recesses in the partitions. There are finger access indentations in the ledge and partitions in order to facilitate the containers being grasping and removed from the channels formed by the partitions.

10 Claims, 3 Drawing Sheets

GRAVITY FED DISPLAY AND DISPENSER

BACKGROUND OF THE INVENTION

1. Field of the Invention

The invention relates to a gravity fed display and dispenser, and more particularly to a display and dispenser unit for retaining and dispensing small cylindrical containers, such as those containing aspirin, acetaminophen, ibuprofen, decongestants, antihistamine and caffeine tables or caplets.

SUMMARY OF THE INVENTION

It is a common practice in convenience stores to have display stands with small, flexible packages of a very limited number of tablets or caplets. Where it is desired to display for purchase reclosable containers holding a greater number of tablets or caplets, the store must provide shelf facilities which are very expensive and inconvenient, particularly when only a relatively small number of caplets or tablets are contained in reclosable containers. Besides being inconvenient and utilizing expensive display space, it is very difficult to maintain small, reclosable containers in an orderly fashion. Oftentimes, these small containers are loaded into bins which make it difficult to keep track of the supply and are inconvenient for customers.

OBJECTS AND SUMMARY

It is an object of the instant invention to have a compact, orderly combination display and dispenser which will hold a large number of various branded products in a compact and attractive setting.

It is another object of the invention to provide a combined dispenser and display wherein the proprietor can easily monitor the level of products sold and the number needed to be replaced in order to always have a proper number available for purchase.

Finally, it is an object of the invention to provide a display device which is gravity fed whereby there will always be a proper number of units displayed and dispensed.

The instant invention includes a gravity fed display and dispenser having a rear wall and a base ledge extending from the rear wall adjacent the bottom of the dispenser. A plurality of partitions extend at least substantially between the rear wall and a front cover, forming side-by-side channels, each channel receiving a plurality of containers which are fed by gravity and displayed in successive order. The rear wall, base ledge and partitions are formed in a single molded unit, with the cover resting in recesses in the partitions. There are finger access indentations in the ledge and partitions in order to facilitate the containers being grasping and removed from the channels formed by the partitions.

These and other objects, features and advantages of the present invention will become more apparent when considered in connection with the illustration of a specific embodiment of the invention and accompanying drawings which form a part hereof, and wherein:

DETAILED DESCRIPTION OF THE PREFERRED EMBODIMENTS

Figure 1:
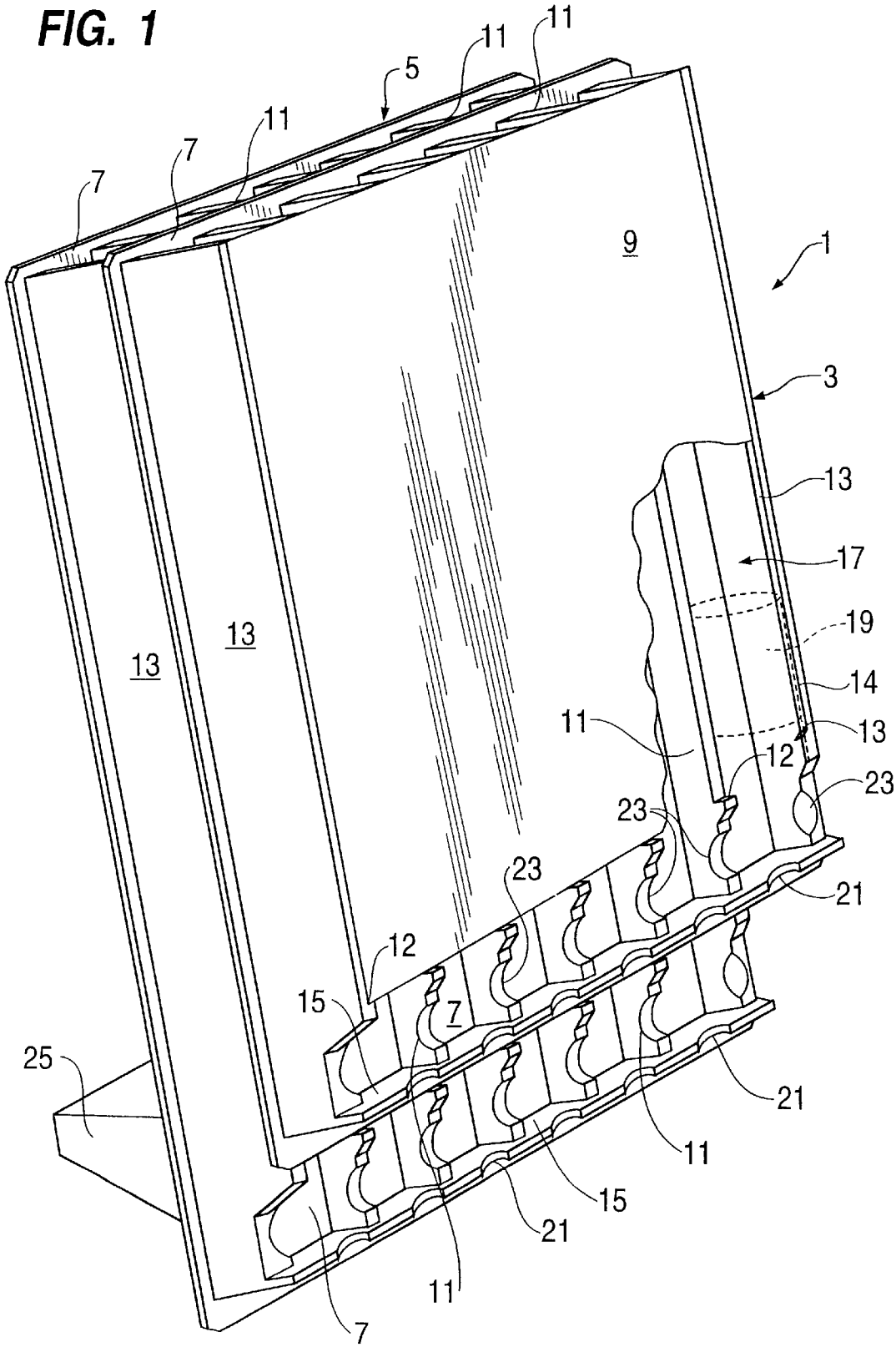
FIG. 1 is a prospective view of a preferred embodiment of the invention with the cover partially broken away and containers seen in dotted lines.
Figure 2:
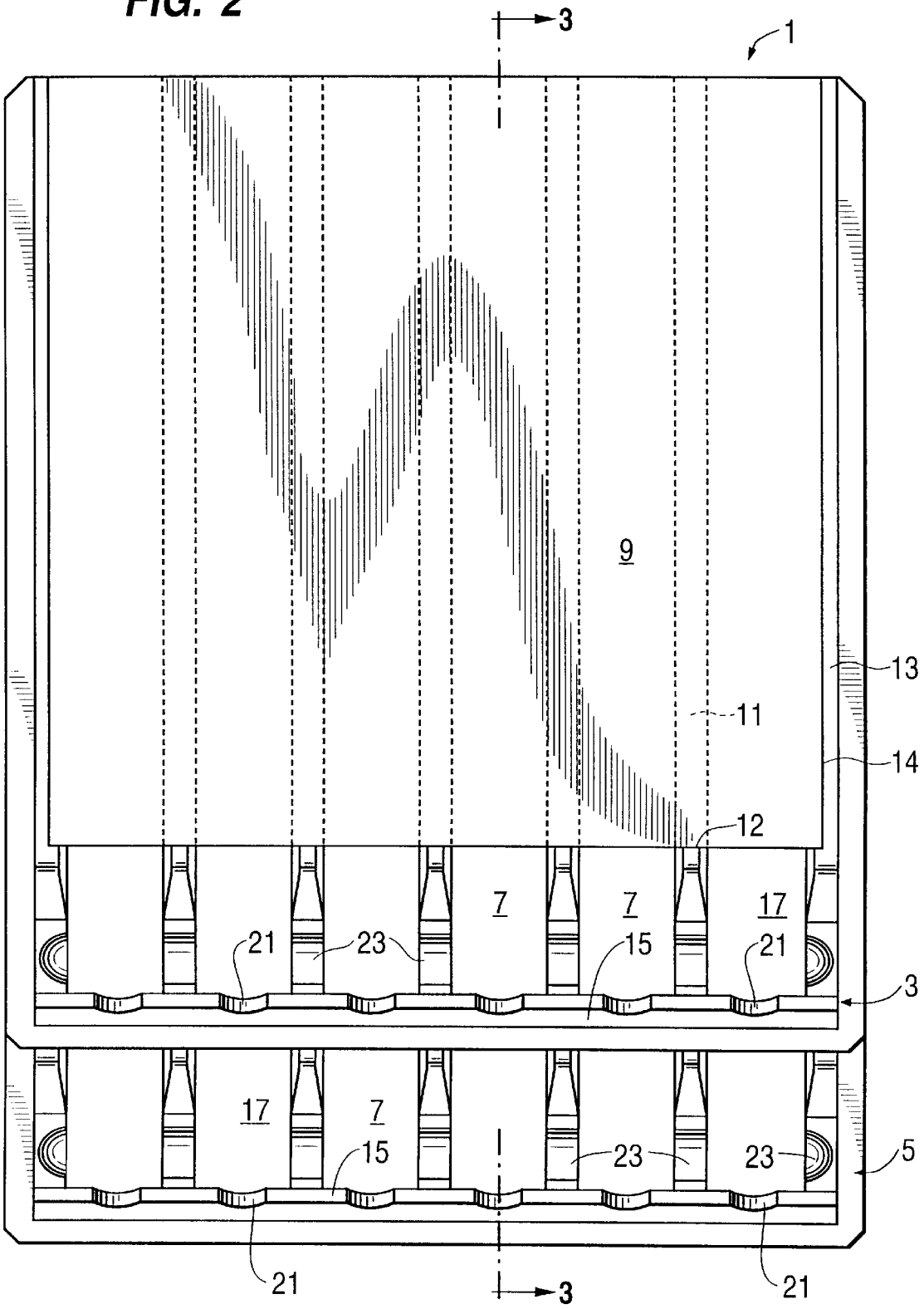
FIG. 2 is a front elevation view thereof.

Referring now to the drawings, a combined display and dispenser is seen generally at 1. The dispenser is illustrated with two superimposed, substantially identical display units, the first being generally designated as 3, and the second generally as 5. Each display/dispenser has a rear wall 7. The first unit 3 has a front wall 9, and the rear wall of the first display actually forms a cover of the second unit.

There are a plurality of partitions 11 which extend substantially between the rear wall 7 and the front cover 9. These partitions 11 are referred to as intermediate partitions. A plurality of side partitions 13 appear on each side of the display. A ledge 15 extends from the rear wall and is located adjacent the bottom of each of the display/dispenser units.

Figure 3:
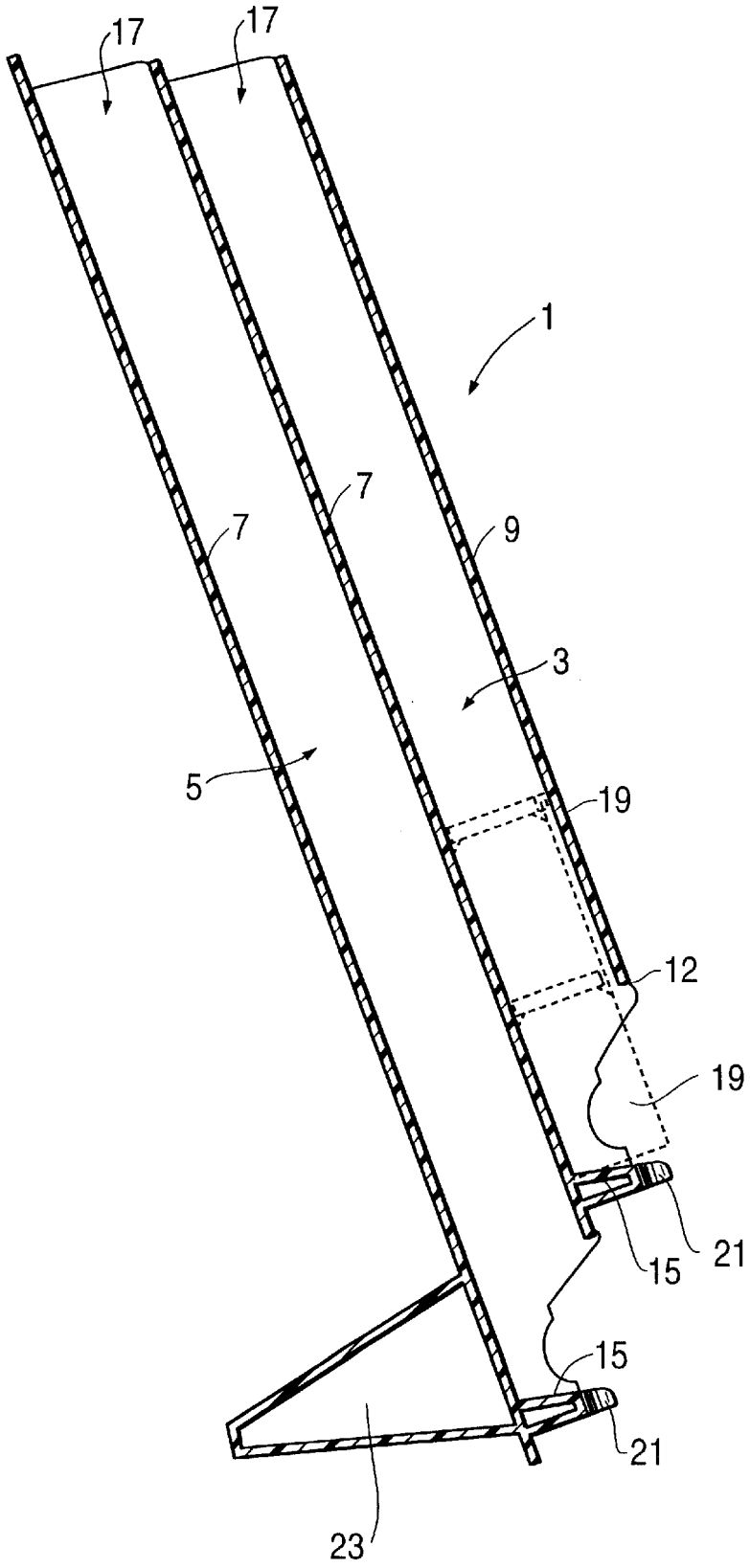
FIG. 3 is a section view taken along lines 3—3 of FIG. 2.

The partitions 11 and 13 form a plurality of channels 17 to receive objects such as reclosable containers seen in dotted lines as 19 and FIGS. 1 and 3.

The containers 19 are inserted at the top of the display/dispenser into the appropriate channel for the particular product being dispensed in accordance with indicia on the front of the cover.

The ledges 15 include a plurality of finger access indentations 21, which together with finger access indentations 23 in the side partitions, facilitate the grasping and removal of the container from the channel.

A tilt-back support seen generally as 25 in FIGS. 1 and 3 assist in providing a tilting angle to the display/dispenser. This type of support is exemplary; obviously, other types may be used to maintain the display vertically are within the scope of the invention, as is a hanging-type display/dispenser.

The cover 9 rests on ledges 12 on partitions 11 in order to hold it in place. Ledge 12 on the outside partition 13 extend upwardly at 14 on the side panels.

Other embodiments of the invention will be apparent to those skilled in the art from consideration of the specification and practice of the invention disclosed herein. It is intended that the specification be considered as exemplary only, with the true scope and spirit of the invention being indicated by the following claims.

What is claimed is:

1. A gravity fed display and dispenser having a top and a bottom, comprising:

a) a rear wall;

b) a front cover;

c) a base ledge extending from the rear wall adjacent the bottom; and d) a plurality of partitions having recesses receiving the cover, each of the partitions extending at least substantially between the rear wall and the front cover thereby forming side-by-side channels, and each channel receiving a plurality of objects to be gravity fed and displayed in successive order.

2. The display of claim 1, wherein the rear wall, base ledge and partitions are formed in a single molded unit.

3. The display of claim 1 including a pair of side partitions and at least one intermediate partition.

4. The display of claim 3, wherein the side partitions each have a recess to receive a side of the cover and a recess receiving the bottom of the cover.

5. The display of claim 3, wherein each partition has a recess receiving the bottom of the cover.

6. The display of claim 1, wherein at least some of the partitions have finger access indentations whereby an object may be easily grasped and removed from the channel.

7. The display of claim 1, wherein the ledge has a plurality of finger access indentations, whereby an object may be easily removed from the channels.

8. The display of claim 1, including a tilt-back support positioned on the rear wall whereby the display may be tilted at an angle to a surface upon the display rests.

9. The display of claim 1, including a second substantially identical display upon which the first display is superimposed, the first display forming the cover for the second display.

10. The display of claim 1, wherein the rear wall has an inside and an outside and including a substantially rigid support positioned on the outside of the rear wall to provide added rigidity to the display.

* * * * *